US005282593A

United States Patent [19]

Fast

[11] Patent Number: 5,282,593

[45] Date of Patent: Feb. 1, 1994

[54] ADJUSTABLE LEG

[75] Inventor: Duane Fast, Valley City, N. Dak.

[73] Assignee: Tri W-G, Inc., Valley City, N. Dak.

[21] Appl. No.: 894,443

[22] Filed: Jun. 5, 1992

[51] Int. Cl.[5] ..... F16M 11/00; A47B 9/00

[52] U.S. Cl. ..... 248/188.4; 248/405; 108/147

[58] Field of Search ..... 248/188.4, 405, 688, 248/157, 188.2, 354.3, 650; 108/147

[56] References Cited

U.S. PATENT DOCUMENTS

| | | | |
|---|---|---|---|
| 759,189 | 5/1904 | Parsons | 248/405 X |
| 1,073,294 | 9/1913 | Siewert | 248/354.3 X |
| 1,279,346 | 9/1918 | Hultgren | 248/405 |
| 4,635,565 | 1/1987 | Novak | 108/147 |
| 5,116,004 | 5/1992 | Luecke | 248/157 X |

FOREIGN PATENT DOCUMENTS

| | | | |
|---|---|---|---|
| 3125904 | 1/1983 | Fed. Rep. of Germany | 108/147 |
| 0159404 | 6/1990 | Japan | 248/354.3 |
| 30469 | 1/1904 | Switzerland | 248/188.2 |

*Primary Examiner*—Karen J. Chotkowski

*Attorney, Agent, or Firm*—Merchant, Gould, Smith, Edell, Welter & Schmidt

[57] ABSTRACT

An adjustable leg for tables and other platforms includes elevating mechanism in the form of a plurality of screw members which are appropriately rotated and also includes rotation preventing mechanism telescopingly extending through the hollow portion of the screw members to hold the lower screw member non-rotatable so that the leg can move in extension and retraction. In this way, the leg solves the problem of having a sufficiently low elevation for the table when the legs are retracted and a sufficiently high elevation for the table when the legs are extended.

4 Claims, 4 Drawing Sheets

ADJUSTABLE LEG

FIELD OF THE INVENTION

The present invention is directed to an adjustable leg and, more particularly, to usually a plurality of such legs which extend and retract to allow height adjustment for commonly a physical therapy table.

BACKGROUND OF THE INVENTION

Vertically adjustable tables, thus requiring vertically adjustable legs, are known and used typically as computer stands, drafting tables, physical therapy tables, etc. Although a single leg may be adjusted, typically all legs are interconnected and adjusted simultaneously an equal amount thereby moving the tabletop up or down as desired.

Known tables have non-rotatable, hollow, telescopic leg members. A threaded nut is fixed near the inside top of the lower member. A threaded rod is threaded through the nut and extends into the hollow portion of each of the leg members. A sprocket is fastened at the top of the threaded rod and is driven by a common chain which drives similar sprockets on all legs. The upper leg member is fastened to the tabletop, and it prevents the lower leg member from rotating, when the threaded rod is rotated, by cooperation between a keeper and keeper slot in the lower and upper leg members, respectively. The Assignee of this application presently markets a physical therapy table of this type. U.S. Pat. Nos. 2,721,106 and 3,587,482 disclose variations of a similar table.

The problem with the legs on these known tables is that the range of height adjustment is too limited when the lowest level is maintained at an advantageous low level. Particularly with respect to a physical therapy table, greater height adjustment is advantageous when the lowest level is no greater than the height of the seat surface of a wheelchair. To achieve greater height adjustment with the known design, the threaded rod must be longer, but that requires the lowest level of the table to be too high.

SUMMARY OF THE INVENTION

The present invention is directed to an adjustable leg which provides for greater extension than the prior art, without requiring an elevated lower or retraction position. The adjustable leg includes first and second mechanism for telescoping between a retracted position and an extended position, first and second mechanism for connecting the first and second telescoping mechanism to the platform, mechanism for driving one of first members of the first telescoping mechanism in rotation to cause either retraction to the retracted position or extension to the extended position, and mechanism for preventing rotation of another of the first members by coupling it to one of second members of the second telescoping mechanism. The second members are non-rotatable.

More particularly, the first telescoping mechanism includes a first-stage screw member which is driven in rotation, along with the other first-stage screw members of other legs, by a motor driving a chain and a sprocket. A third-stage screw member is held non-rotatable by torque resisting members which telescopingly extend from the tabletop to the third-stage screw member. A second-stage screw member fits between the first and third screw members and in doing so provides extension not achievable by the prior art, without giving up a low elevation starting position.

DETAILED DESCRIPTION OF THE PREFERRED EMBODIMENT

Figure 1:
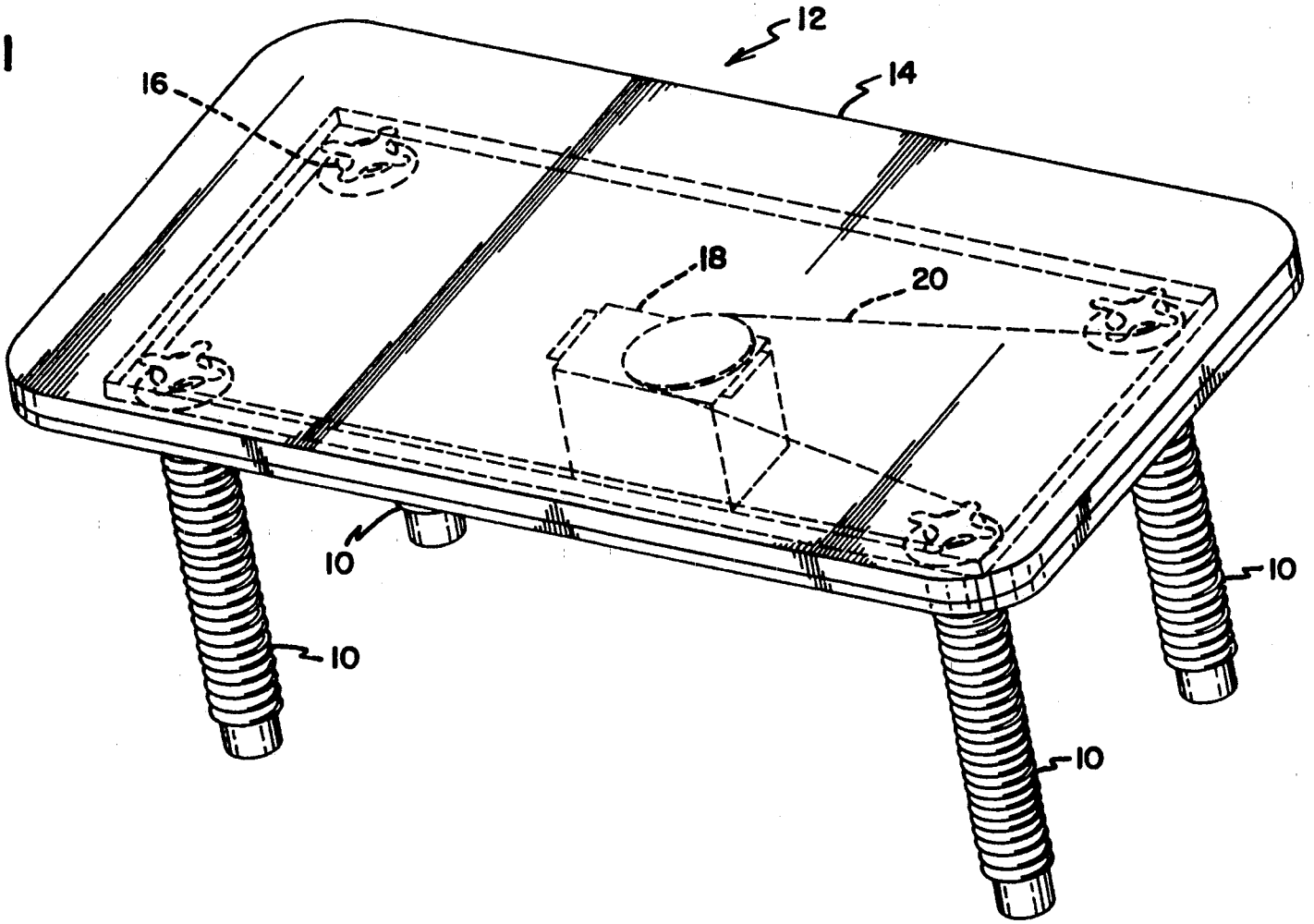
FIG. 1 is a perspective view of a physical therapy table having an adjustable leg in accordance with the present invention.
Figure 4:
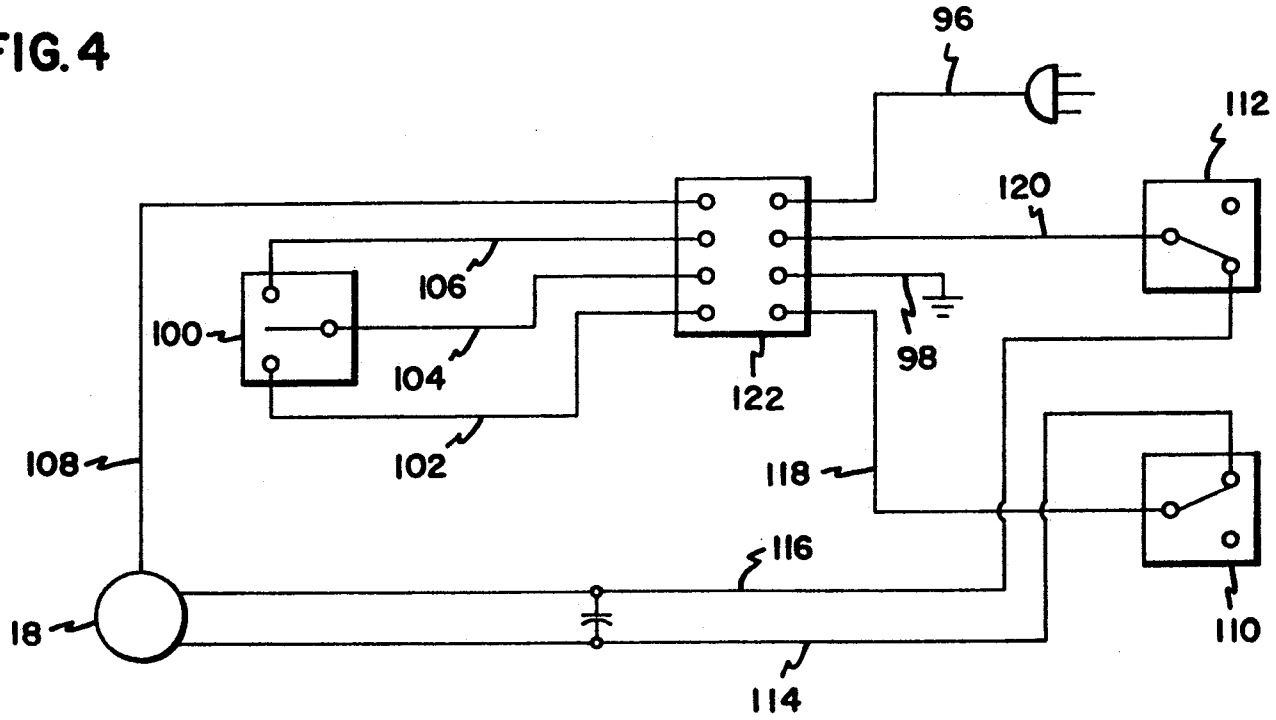
FIG. 4 is an electrical schematic relevant to limiting the drive system in retraction and extension.

Referring now to the drawings wherein like reference numerals designate identical or corresponding parts throughout the several views, and more particularly to FIG. 1, an adjustable leg in accordance with the present invention is designated generally by the numeral 10. Four of such legs 10 are shown relative to a physical therapy table 12. Table 12 includes a top commonly having a frame (not independently shown) with a padded surface 14 attached thereto. Each of legs 10 includes a sprocket 16 which is driven by a motor unit 18 and a chain 20. A control system is not shown, although is schematically depicted in the electrical circuit diagram of FIG. 4.

Figure 2:
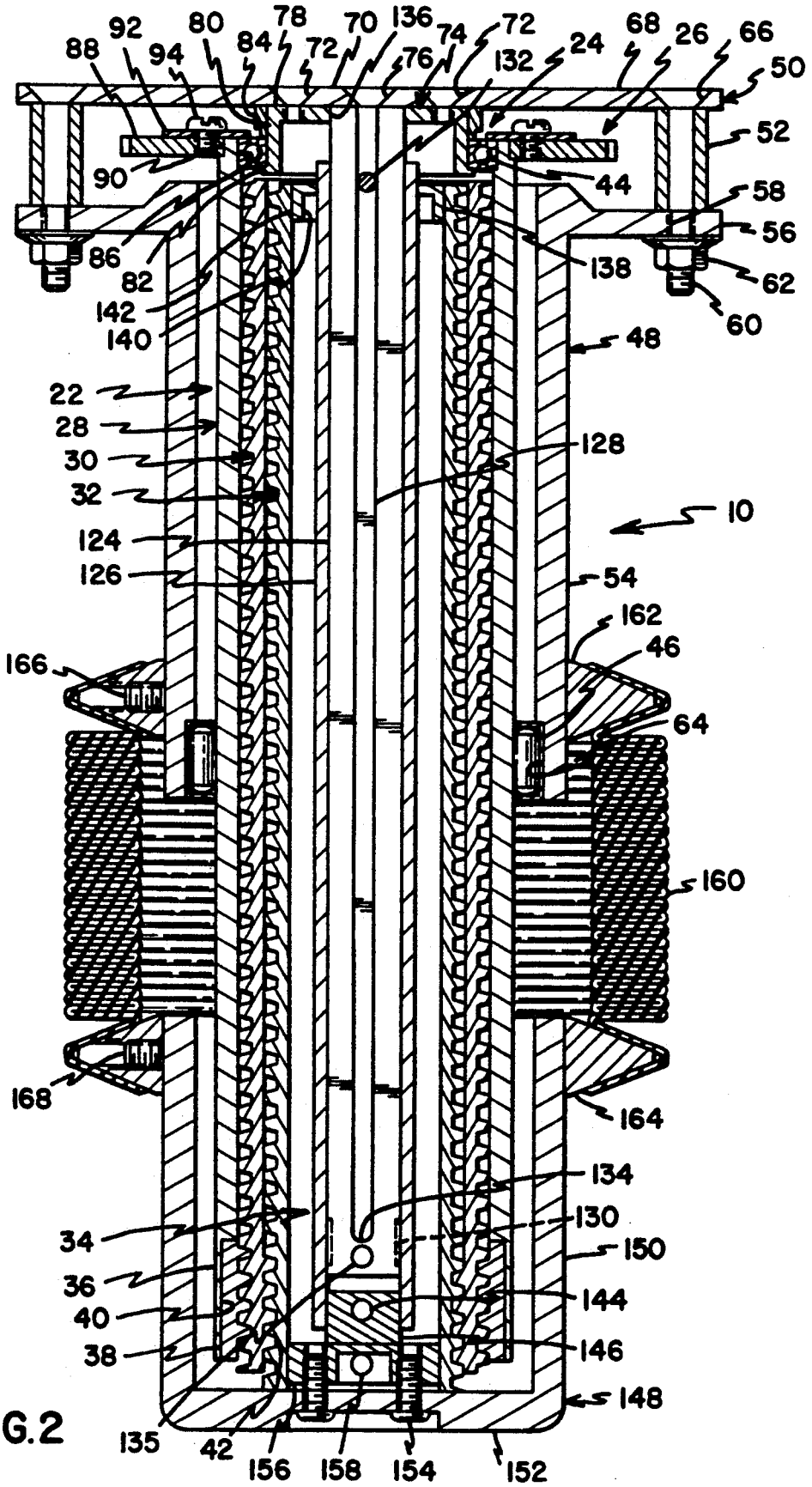
FIG. 2 is a cross-sectional view in a retracted position of the legs of the table shown in FIG. 1.
Figure 3:
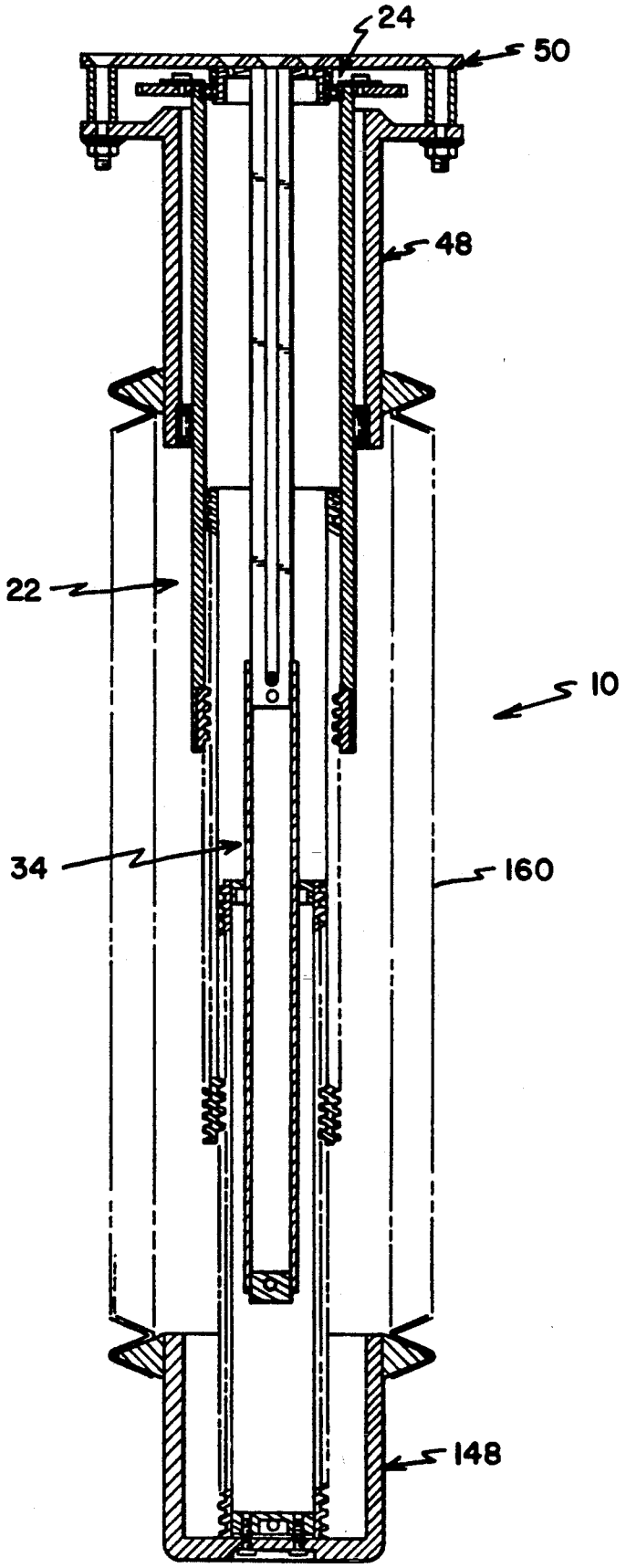
FIG. 3 is a cross-sectional view of the leg of FIG. 2 shown however, in an extended position.

With reference to FIGS. 2 and 3, adjustable leg 10 includes mechanism 22 for elevating the tabletop, or what could be any platform, with respect to the floor, or what could be any fixed surface. Mechanism 24 rotatably supports elevating mechanism 22 with respect to the tabletop. Mechanism 26 rotatably drives elevating mechanism 22. Elevating mechanism 22 includes a plurality of screw members 28, 30, 32. Mechanism 34 prevents rotation of screw member 32 so that as the others are rotated, they will move longitudinally with respect to one another and extend or retract the leg.

Adjustable leg 10 extends between a retracted position as shown in FIG. 2 and an extended position as shown in FIG. 3. Likewise, elevating mechanism 22 and rotation preventing mechanism 34 telescope between retracted and extended position. Elevating mechanism 22 includes first screw member 28, second screw member 30, and third screw member 32. First screw member 28 includes a cylindrical member 36 and a threaded insert 38 retained by friction fit or otherwise in an internal recess 40 at the bottom end of cylindrical member 36. Second screw member 30 is also cylindrical and has threads along its outer surface. The outer diameter of second screw member 30 is only slightly smaller than the inner diameter of cylindrical member 36. First screw member 28 and second screw member 30 have similar lengths, although in the retracted position, second screw member 30 stops a little more than the thickness of bearing 44 beneath the top end of screw member 28. The internal threads of insert 38 of first screw member 28 mate with the external threads of second screw member 30. For a distance of approximately the same axial length as insert 38 and extending from the bottom end thereof, second screw member 30 has internal threads 42. It is understood that second screw member 30 could have an insert with threads similar to insert 38 and that similarly first screw member 28 could have internal threads in a fashion similar to threads 42 of second screw member 30.

Third screw member 32 is also cylindrical and has threads extending the entire length of the outer surface. The outer diameter of third screw member 32 is only slightly smaller than the inner diameter of second screw member 30. Third screw member 32 has length approximately the same as second screw member 30. The external threads of third screw member 32 mate with the internal threads 42 of second screw member 30.

Mechanism 24 for rotatably supporting elevating mechanism 22 includes a pair of roller bearings 44, 46 as appropriately installed between structure attached to the tabletop and elevating mechanism 22. Supporting mechanism 24 further includes housing 48 separated from cover 50 by a plurality of spacers 52. Housing 48 has a cylindrical body 54 with a flange 56 at the top thereof. A plurality of regularly spaced openings 58 are formed in flange 56 to receive bolts 60 for securing top 50 and spacers 52 to housing 48. The frame (not shown) of the tabletop is attached to adjustable leg 10 by removing nuts 62 and receiving it between flange 56 and reinstalled nuts 62 as the lower end of bolts 60 pass through appropriate openings in the frame (not shown) of the tabletop.

Bearing 46 is friction fitted into a recess 64 at the lower end of cylindrical portion 54 of housing 48. The lower end is located so that bearing 46 is positioned approximately half way along the length of first screw member 28. If necessary, a retainer may be fastened at the end of cylindrical portion 54 to secure bearing 46. The inside diameter of cylindrical portion 54 is sized to appropriately receive bearing 46 relative to first screw member 28. Bearing 46 is commercially available and known to those skilled in the art.

Top 50 is a flat plate having a plurality of lobes extending outwardly from a central portion (see FIG. 1). A counter-sunk opening 66 is formed in each lobe 68 to receive bolt 60. The central portion 70 of cover 50 has a pair of counter-sunk openings 72 to receive screws (not shown) to attach bearing support 74. A counter-sunk centered opening 76 is formed to receive a screw (not shown) to attach rod 124 thereto.

Bearing support 74 has a flat top 78 with a cylindrical skirt 80. Top 78 has openings in alignment with openings 72 and a central opening to receive rod 124. Skirt 80 is cylindrical with a protrusion 82 at the bottom end. Bearing 44 fits about skirt 80 down to protrusion 82. A retainer 84 fits thereover and is held in place by cover 50. Bearing 44 is therefore secured between protrusion 82 and retainer 84 on skirt 80. Bearing 44 also fits in recess 86 at the upper, inner end of cylindrical portion 36 of first screw member 28. Sprocket 88 fits in recess 90 at the upper, outer end of cylindrical portion 36. A washer 92 is fastened to sprocket 88 with screws 94. Washer 92 extends not only along a portion of the upper surface of sprocket 88, but also across the upper end of first screw member 28 and the upper end of bearing 44. In this way, in addition to the friction fit of bearing 44 in recess 86, washer 92 prevents mechanism 22 from falling until sprocket 88 would contact housing 48.

Mechanism 26 for rotatably driving elevating mechanism 22 includes not only sprocket 88, but also chain 20 and motor 18 in a fashion known to those skilled in the art. Motor 18 can be controlled to rotate in both forward and reverse directions and can be controlled to start and stop at any time, as well as when specific circumstances occur. In this regard, with reference to the circuit diagram of FIG. 4, alternating current power 96 is provided relative to ground 98. Motor 18 is empowered by switch 100 in one direction via lines 102, 104, and in the other direction via lines 104, 106. The circuit to motor 18 is completed via lines 108 and through limit switches 110, 112, representing retracted and extended directions. Lines 114, 116 lead from motor 18 to switches 110, 112. Lines 118, 120 lead from switches 110, 112 to terminal 122.

Mechanism 34 for preventing rotation of third screw member 32 with respect to the tabletop includes rod 124 and tube 126 which telescope with respect to one another. Rod 124 has a square cross-section and a pair of slots 128 on opposite sides thereof and extending from the top end to near the bottom end. A screw (not shown) is inserted in opening 76 in cover 50 and threads into an appropriate opening in the top of rod 124. Nylon pads 130 on opposite sides of rod 124 are fastened in recesses in rod 124 to fill any space to reduce "play" between rod 124 and tube 126. Alternatively, there may be a passage through rod 124 connecting the recesses and a spring therein to force pads 130 outwardly. Pads 130 not only reduce play, but also eliminate any noise which may occur between rod 124 and tube 126 during initial positioning when the screw members begin to rotate and increase friction between rod 124 and tube 126 to discourage any potentially noisy free sliding of tube 126. Alternatively, biased plungers (not shown) can be loaded in openings 135 on the opposite sides of rod 124 as nylon pads 130 to also discourage any potentially noisy free sliding of tube 126.

Tube 126 has a square cross-section which conforms substantially to the square cross-section of rod 124. A pair of pins 132 are fastened to opposite sides of tube 126 near the top of tube 126. Pins 132 project into slots 128 and when elevating mechanism 22 has extended leg 10 sufficiently far, pins 132 contact the lower end 134 of slots 128 so as to pull tube 126 upwardly with respect to third screw member 32 as elevating mechanism 22 continues to extend leg 10.

As indicated, rod 126 is fastened to cover 50 with a screw in opening 76 and is prevented from rotating by an opening 136 in bearing support 74 conforming to the outer cross-section of rod 124. Tube 126 does not rotate since its inside shape conforms substantially with the cross-section of rod 124 with "play" being reduced by pads 130. This telescoping mechanism furthermore prevents third screw member 32 from rotating since guide member 138 fastened at the inside top of screw member 32 includes an opening closely conforming with the outside square diameter of tube 126. Guide member 138 includes a recess 140 between tube 126 and the wall 142 of guide member 138. A spiral pin (not shown) extends from guide member 138 outwardly through and beyond the wall of third screw member 32 to provide a stop on upward movement of second screw member 30. Pin (not shown) extends through opening 144 of rubber bumper 146 and also through aligned openings (not shown) in tube 126 to not only secure bumper 146 to tube 126, but to extend beyond tube 126 on opposite sides thereof so as to move into recess 140 as tube 126 approaches the end of its travel during extension of leg 10.

Cup member 148 has a cylindrical side 150 having the same dimensions as cylindrical body 54 of housing 48. The bottom 152 of cup member 148 is fastened with screws 154 to insert 156 which is also secured to the bottom of third screw member 32 at opening 158 with a spiral pin (not shown) or otherwise. The spiral pin extends beyond the outer cylindrical profile of third screw member 32 to provide a stop for second screw member 30. Cup member 148 functions as a stable bottom for adjustable leg 10. Since third screw member 32 does not rotate as indicated earlier, cup member 148 also does not rotate.

The moveable parts of leg 10 are shielded from persons using a table having adjustable legs 10 by bellows member 160. A pair of rings 162, 164 are fastened with set screws 166, 168 to the lower end of cylindrical body 54 of housing 48 and the upper end of cylindrical side 150 of cup member 148. Rings 162, 164 preferably have a V-shaped outermost periphery so that the end folds of baffle member 160 can fit thereover and be retained thereby. As leg 10 moves in extension and thereafter in retraction, baffle member 160 unfolds and folds, respectively.

In use, legs 10 are preferably assembled in the form shown in FIG. 2 and installed in the frame of a tabletop as depicted in FIG. 1. Chain 20 is appropriately threaded around the various sprockets and the driving member of motor 18. Cover 50 is formed so that chain 20 can be easily installed about sprocket 88. When switch 100 is functioned to rotate sprocket 88 in a direction to extend leg 10, elevating mechanism 22 and rotation preventing mechanism 34 telescope with respect to one another as shown in FIG. 3. As sprocket 88 turns, first screw member 28 likewise turns. Threaded insert 38 begins threading second screw member 30 downwardly. At the same time, second screw member 30 at threads 42 begins turning third screw member 32 downwardly. So that elevating mechanism 22 extends, rather than simply rotates, it is necessary that third screw member 32 be non-rotatable. In that regard, rod 124, tube 126 and guide member 138 counter any torquing applied by rotational forces exerted on third screw member 32 and, consequently, hold screw member 32 from rotating. As elevating mechanism 22 extends, tube 126 telescopes with respect to rod 124 until pin 132 contacts bottom 134 of slot 128. Thereafter, tube 126 extends with respect to third screw member 32 (see FIG. 3). As elevating mechanism 22 and rotation preventing mechanism 34 extend and telescope with respect to one another, bellows member 160 expands.

One of limit switches 110 or 112 stops any further extension, while the other stops any further retraction. When legs 10 have been fully extended, switch 100 may be operated to cause motor 18 to move chain 20 in the opposite direction and retract legs 10. Elevating mechanism 22 and rotation preventing mechanism 34 then function in reverse and telescope into one another. When fully retracted, portions of first, second, and third screws 28, 30, 32 are received within cylindrical portion 54 of housing 48 while portions at the other ends thereof are received within cylindrical portion 150 of cup member 148. Likewise, when fully retracted, portions of rod 124 and tube 126 are received within cylindrical portion 54 of housing 48 and other portions within cylindrical portion 150 of cup member 148.

Because there is rotation preventing mechanism extending through the hollow portions of the screw members, and because the mechanism telescopes, an adjustable leg in accordance with the present invention can have more than two screw members. Furthermore, it is apparent there could be more than three. Similarly, there can be more rotation preventing members than shown. In any case, the multiplicity of screw members and rotation preventing members allows each of the various members to be shorter than would otherwise be possible. In that way, the table can have a relatively low elevation when the legs are fully retracted. On the other hand, depending on the number of telescoping members of both the elevating mechanism and the rotation preventing mechanism, the legs can extend so that the table can also have a relatively high elevational position when the legs are fully extended. Thus, it is possible in the case of a physical therapy table to have the upper surface of the table not only at the level of the seat of a wheelchair, but beneath it, and even to the point of being to the level of a child's wheelchair. This is very important for physical therapists who must help wheelchair patients from wheelchairs to a physical therapy table. It avoids awkward stress positions for them and particularly saves their backs.

Thus, features and advantages of the present invention, together with the details of the structure and function, have been set forth in accordance with a preferred embodiment. It is apparent, however, that the disclosure is illustrative and therefore that changes, especially in matters of shape, size, and arrangement, to the full extent of the general meaning in the terms in which the claims are expressed, are within the principle of the invention.

What is claimed is:

1. An adjustable leg for supporting a platform above a floor, comprising:

a hollow first screw with first internal threads;

means for rotatingly supporting said first screw with respect to said platform;

means for rotating said first screw;

a hollow second screw with second internal and first external threads, said first internal and first external threads mating with one another;

a hollow third screw with second external threads, said second internal and second external threads mating with one another;

a bar fixedly attached to said platform, said bar extending into said first screw;

means rotationally fixed with respect to said third screw for non-rotatably and telescopingly receiving said bar;

wherein said bar and said bar receiving means hold said third screw from rotating and allow said third screw to non-rotatably provide support for said platform with respect to said floor.

2. An adjustable leg supporting a platform with respect to a fixed surface, comprising:

a hollow means for elevating said platform with respect to said fixed surface, said elevating means including a plurality of screw members with adjacent pairs screwable with respect to one another;

means for rotatably supporting one of said screw members of said elevating means with respect to said platform;

means for rotatably driving said elevating means;

means inside said hollow elevating means for preventing rotation of another of said screw members with respect to said platform, said rotation preventing means including a plurality of non-rotatable members with respect to one another, one of said non-rotatable members being attached to said platform and another of said non-rotatable members being attached to said another of said screw members;

a cup member spaced from said platform and means for attaching said cup member to said another of said screw members, first portions of each of said screw members and said non-rotatable members being received in said cup member when said adjustable leg is fully retracted; and a housing extending from said platform, second portions of each of said screw members and said non-rotatable members being received in said housing when said adjustable leg is fully retracted.

3. The adjustable leg in accordance with claim 2 including a bellows member extending between said cup and said housing, said bellows member with said cup and said housing fully enclosing said screw members.

4. An adjustable leg supporting a platform with respect to a fixed surface, comprising:

hollow means for elevating said platform with respect to said fixed surface, said elevating means including a plurality of screw members with adjacent pairs screwable with respect to one another;

means for rotatably supporting one of said screw members of said elevating means with respect to said platform, said rotatable supporting means including a pair of roller bearings;

means for rotatably driving said elevating means;

means inside said hollow elevating means for preventing rotation of another of said screw members with respect to said platform, said rotation preventing means including a plurality of non-rotatable members with respect to one another, one of said non-rotatable members being attached to said platform and another of said non-rotatable members being attached to said another of said screw members.

* * * * *